United States Patent [19]

Matsudo et al.

[11] 4,290,860

[45] Sep. 22, 1981

[54] PROCESS FOR MANUFACTURING ELECTRO-GALVANIZED STEEL SHEET EXCELLENT IN PAINT ADHERENCE

[75] Inventors: Kazuo Matsudo; Takeshi Adaniya; Masaru Ohmura; Masahiro Shoji, all of Fukuyama; Tsutomu Watanabe, Yokosuka, all of Japan

[73] Assignee: Nippon Kokan Kabushiki Kaisha, Tokyo, Japan

[21] Appl. No.: 156,580

[22] Filed: Jun. 5, 1980

[30] Foreign Application Priority Data

Jul. 2, 1979 [JP] Japan ..... 54-82670

[51] Int. Cl.[3] ..... C25D 7/06; C25D 3/56

[52] U.S. Cl. ..... 204/27; 204/43 Z

[58] Field of Search ..... 204/27, 43 Z, 43 T, 204/44

[56] References Cited

U.S. PATENT DOCUMENTS

| | | | |
|---|---|---|---|
| 3,791,801 | 2/1974 | Ariga | 204/43 Z |
| 4,048,381 | 9/1977 | Adaniya | 204/43 Z |

FOREIGN PATENT DOCUMENTS

| | | | |
|---|---|---|---|
| 47-16522 | 5/1972 | Japan | 204/43 Z |
| 48-28334 | 4/1973 | Japan | 204/43 Z |
| 49-19979 | 5/1974 | Japan | 204/43 Z |
| 51-83838 | 7/1976 | Japan | 204/43 Z |
| 786418 | 11/1957 | United Kingdom | 204/43 Z |

*Primary Examiner*—T. M. Tufariello

*Attorney, Agent, or Firm*—Frishauf, Holtz, Goodman & Woodward

[57] ABSTRACT

In an acidic zinc sulfate and iron sulfate electro-galvanizing bath, of which a pH value has been adjusted to under 1.5, containing iron from 20 to 90 wt. % relative to the total amount of metals capable of being electro-deposited in said acidic electro-galvanizing bath, a steel sheet is subjected to an electro-galvanizing treatment, with an electric current having a current density of from 10 to 40 A/dm$^2$ to form on said steel sheet an electro-galvanized layer in a weight of from 1 to 50 g/m$^2$, containing iron from 5 to 35 wt. % relative to the total weight of the electro-galvanized layer.

2 Claims, No Drawings

PROCESS FOR MANUFACTURING ELECTRO-GALVANIZED STEEL SHEET EXCELLENT IN PAINT ADHERENCE

REFERENCE TO PATENTS, APPLICATIONS AND PUBLICATIONS PERTINENT TO THE INVENTION

As far as we know, there are available the following prior documents pertinent to the present invention:

(1) Japanese Patent Publication No. 16,522/72 dated May 16, 1972;

(2) Japanese Patent Publication No. 19,979/74 dated May 21, 1974; and, (3) Japanese Patent Provisional Publication No. 83,838/76 dated July 22, 1976.

The contents of the prior arts disclosed in the above-mentioned prior documents (1) to (3) are described hereinafter under the heading of the "BACKGROUND OF THE INVENTION".

FIELD OF THE INVENTION

The present invention relates to a process for manufacturing an electro-galvanized steel excellent in paint adherence and more specifically to a process for forming on a steel sheet, by subjecting said steel sheet to an electro-galvanizing treatment in an acidic electrogalvanizing bath, a uniform electro-galvanized layer which is excellent in paint adherence and in corrosion resistance after applied with a painting thereto (hereinafter, referred to as "post-painting corrosion resistance").

BACKGROUND OF THE INVENTION

There is recently a keen demand for a higher post-painting corrosion resistance of steel sheets applied in home electrical appliances and automotive body. For example, with a view to preventing damage to an automobile caused by salt used for melting ice and snow on the road in a cold district in winter, importance is attached to the improvement of corrosion resistance of a steel sheet for automotive outer shell, underside and closed structures, and the demand for steel sheets having an excellent post-painting corrosion resistance is increasing.

Electro-galvanized steel sheet is widely applicable also as a substrate steel sheet for painting because of many advantages such as the quality of steel sheet not deteriorated, the excellent formability and the possibility of easily applying a one-side galvanizing treatment since an excellent corrosion resistance is imparted to the steel sheet under the effect of sacrificial corrosion prevention of an electro-galvanized layer formed on the surface of the steel sheet, with applicability of a steel sheet of any desired quality, and the steel sheet is never exposed to heating to a high temperature during the galvanizing process.

In an electro-galvanized steel sheet, however, when applying paint onto the surface of the electro-galvanized layer which acts as a substrate for painting the, progress of corrosion causes occurrence of blisters in the interface between the electro-galvanized layer and the paint film. As a result, the electro-galvanized steel sheet was defective in that adhesion of a painting film to the electro-galvanized layer was seriously decreased, thus leading to a poor post-painting corrosion resistance. Occurrence of blisters on the interface between the electro-galvanized layer and the painting film is attributable to the fact that, along with the progress of corrosion, external moisture ($H_2O$) penetrates through the paint film into the corroded portions and is accumulated there. Since this moisture ($H_2O$) contains OH produced by the corrosion reaction, the corroded portions become alkaline (usually with a pH value of 10 or 11). As a result, the paint film is broken by the above-mentioned alkaline corroded portions, thus decreasing the corrosion resistance of the painted galvanized steel.

The following methods are known as those for improving corrosion resistance and paint adhesion of an electro-galvanized steel sheet:

(1) An acidic electro-galvanizing process, disclosed in Japanese Patent Publication No. 16,522/72 dated May 16, 1972, which comprises:

(a) in an acidic electro-galvanizing bath to which has been added with cobalt from 5 to 50 g/l in the form of at least one water-soluble compound of cobalt, subjecting a steel sheet to an electro-galvanizing treatment so that the electro-galvanized layer contains cobalt compounds;

(b) in an acidic electro-galvanizing bath to which has been added cobalt from 0.3 to 20 g/l in the form of at least one of water-soluble compounds of cobalt and also to which has been added at least one water-soluble compound of molybdenum, tungsten or iron, subjecting a steel sheet to an electro-galvanizing treatment so that the electro-galvanized layer contains compounds of said metals.

(2) A steel sheet serving as a substrate for coating, disclosed in Japanese Patent Publication No. 19,979/74 dated May 21, 1974, which comprises:

(a) a metal layer formed on the surface of a steel sheet by an electro-galvanizing treatment, which layer contains Zn, as the main constituent, and another metal, as the sub constituent, in an amount of from 0.05 to 7 wt.% relative to the total weight of the electro-galvanized layer in the form of at least one of the oxides of molybdenum, tungsten, or cobalt;

(b) a metal layer formed on the surface of the steel sheet by an electro-galvanizing treatment, which layer contains Zn, as the main constituent, and another metal, as the sub constituent, in an amount of from 0.05 to 7 wt.% relative to the total weight of the electro-galvanized layer in the form of at least one of the oxides of molybdenum, tungsten, or cobalt, and also contains another metal, as a further sub constituent, in an amount of from 0.5 to 15 wt.% as inetal relative to the total weight of the electro-galvanized layer in the form of at least one of metal or compounds of iron, nickel or tin.

(3) A method for manufacturing a chromated electro-galvanized steel sheet, disclosed in Japanese Patent provisional Publication No. 83,838/76 dated July 22, 1976, which comprises:

in an acidic electro-galvanizing bath principally comprising Zn ion, and containing:

at least one additive selected from the group consisting of:

| | |
|---|---|
| (a) $Cr^{3+}$ | from 50 to 700 ppm, |
| (b) $Cr^{6+}$ | from 50 to 500 ppm, |
| (c) $Cr^{3+}$ and $Cr^{6+}$ | from 50 to 700 ppm, $Cr^{6+}$ being up to 500 ppm, |
| (d) In ion | from 10 to 3,000 ppm, and |
| (e) Zr ion | from 10 to 2,500 ppm, |
| and, further containing: | |
| (f) Co ion | from 50 to 10,000 ppm, |

subjecting a steel sheet to an electro-galvanizing treatment to form a first galvanized layer on the surface thereof; and then, subjecting said electro-galvanized steel sheet having said first galvanized layer thus formed to an ordinary chromating treatment.

An electro-galvanized steel sheet manufacturing by any of the above-mentioned prior arts (1) to (3) is superior in corrosion resistance of the galvanized layer to an ordinary electro-galvanized steel sheet with a pure-zinc galvanized layer, because of the formation of an electro-galvanized layer comprising a combination of zinc and other metals. However, with regard to post-painting corrosion resistance of the above-mentioned superrior electro-galvanized steel sheet, it is impossible as in an ordinary electro-galvanized steel sheet to prevent occurrence of blisters on the interface between the electro-galvanized layer and the paint film, and hence impossible to solve the aforementioned disadvantages.

Under such circumstances, there is a strong demand for the development of an electro-galvanized steel sheet excellent in paint adherence which permits prevention of the occurrence of blisters on the interface between the electro-galvanized layer and the paint film, and is thus excellent in post-painting corrosion resistance but a process for manufacturing an electrogalvanized steel sheet provided with such properties is not as yet proposed.

SUMMARY OF THE INVENTION

An object of the present invention is therefore to provide a process for manufacturing an electro-galvanized steel sheet excellent in paint adherence, which permits prevention of the occurrence of blisters on the interface between the electro-galvanized layer and the painting film, is thus excellent in post-painting corrosion resistance, i.e., corrosion resistance of the interface between the electro-galvanized layer and the paint film, and has a galvanized layer thus formed having a uniform galvanized composition.

In accordance with one of the features of the present invention, there is provided a process for manufacturing an electro-galvanized steel sheet excellent in paint adherence which comprises:

in an acidic electro-galvanizing bath, with a pH value adjusted to under 1.5, containing from 20 to 90 wt.% iron relative to the total amount of metals which are capable of being electro-deposited in said acidic electro-galvanizing bath, subjecting a steel sheet to an electro-galvanizing treatment, to form a electro-galvanized layer on the surface of said steel sheet in a weight of from 1 to 50 g/m$^2$ per side of said steel sheet, containing from 5 to 35 wt.% iron relative to the total weight of the electro-galvanized layer.

DETAILED DESCRIPTION OF PREFERRED EMBODIMENTS

We carried out extensive studies with a view to obtaining an electro-galvanized steel sheet excellent in post-painting corrosion resistance, i.e., corrosion resistance of the interface between the electro-galvanized layer and the paint film, and moreover, giving a galvanized layer having a uniform galvanized composition. As a result, we developed a process for manufacturing an electro-galvanized steel sheet excellent in paint adherence fully provided with the above mentioned properties.

The process for manufacturing an electro-galvanized steel sheet excellent in paint adherence of the present invention comprises:

in an acidic electro-galvanizing bath, with a pH value adjusted to under 1.5, containing from 20 to 90 wt.% iron relative to the total amount of metals which are capable of being electro-deposited in said acidic electro-galvanizing bath, subjecting a steel sheet to an electro-galvanizing treatment, to form on the surface of said steel sheet an electro-galvanized layer in a weight of from 1 to 50 g/m$^2$ per side of said steel sheet, containing from 5 to 35 wt.% iron relative to the total weight of the electro-galvanized layer.

In the present invention, the steel sheet is subjected to an electro-galvanizing treatment in an electro-galvanizing bath containing iron so that the electro-galvanized layer of the steel sheet thus electro-galvanized contains iron, for the purpose of improving post-painting corrosion resistance of the electro-galvanized steel sheet, i.e., corrosion resistance of the interface between the electro-galvanized layer and the paint film. The reason why the addition of iron into the electro-galvanized layer causes an improvement in post-painting corrosion resistance is not as yet accurately known. It is however considered that the addition of iron into the electro-galvanizing layer makes the corrosion potential of the electro-galvanized layer noble, thus reducing the difference in potential between the steel sheet and the electro-galvanized layer, thus resulting in a lower corrosion current density produced between the steel sheet and the electro-galvanized layer, and hence resulting in a lower corrosion rate of the electro-galvanized layer.

Our studies demonstrated that, when the electro-galvanized layer contains iron, corroded portions produced in the steel sheet become neutral, and this improves post-painting corrosion resistance. More particularly, with a view to investigating post-painting corrosion resistance of an electro-galvanized steel sheet, a salt spray test as described later was applied to electro-galvanized steel sheet test pieces to see properties of corroded portions on test pieces on which corrosion (occurrence of blisters and red rust) was caused by the salt spray test. According to the results of this test, in a galvanized steel sheet with a pure-zinc galvanized layer, the galvanized layer is dissolved by an acidic substance (HCl) produced on the cathode side of the corroded portion, whereas the paint film is broken by an alkaline substance (NaOH) produced on the anode side of the corroded portion, and this is considered to cause deterioration of post-painting corrosion resistance.

On the contrary, in an electro-galvanized steel sheet containing iron in the electro-galvanized layer thereof by the process of the present invention, the corroded portion becomes neutral, and the galvanized layer is never dissolved and the paint film is never broken by the acidic and alkaline substances produced at the corroded portion as in an ordinary galvanized steel sheet with a pure-zinc galvanized layer. This is considered to bring about the satisfactory post-painting corrosion resistance. The cause of the corroded portion becoming neutral in the electro-galvanized steel sheet manufactured by the process of the present invention, as mentioned above, is attributable to the fact that a corrosion product of iron ($FeCl_2$) is produced, simultaneously with a corrosion product of zinc ($ZnCl_2$), on the anode side of the corroded portion, and this corrosion product of iron ($FeCl_2$) reacts with the alkaline NaOH produced on the cathode side of the corrosed portion.

Observation of an electro-galvanized layer obtained by the process of the present invention by X-ray diffraction demonstrated that a Zn-Fe alloy such as $FeZn_7$ ($\delta_1$) or $Fe_3Zn_{10}$ ($\tau$) was formed, varying with the iron content, in the electro-galvanized layer. Formation of the abovementioned Zn-Fe alloy decreases the activity of Zinc. As a result, improvement of the adhesion the paint film to the surface of the electro-galvanized layer is obtained, and this is considered to prevent the occurrence of blisters.

The iron content in the electro-galvanized layer, i.e., in the Zn-Fe alloy layer should be within the range of from 5 to 35 wt.% relative to the total weight of the electro-galvanized layer. With an iron content in the Zn-Fe alloy layer of under 5 wt.% relative to the total weight of the electro-galvanized layer, the effect of the addition of iron is slight, with early production of blisters, and post-painting corrosion resistance shows no improvement as compared with that of the conventional electro-galvanized steel sheet. On the other hand, with an iron content in the Zn-Fe alloy layer of over 35 wt.% relative to the total weight of the electro-galvanized layer, iron in the Zn-Fe alloy layer becomes excessive. As a result of this, the effect of the addition of iron is reduced, causing appearance of properties of iron allowing easy corrosion, thus resulting in the production of rust on the steel sheet, giving no improvement in post-painting corrosion resistance.

The iron content in the electro-galvanizing bath should be within the range of from 20 to 90 wt.% relative to the total weight of metals which are capable of being electro-deposited in said galvanizing bath, i.e., relative to the total weight of zinc and iron contained in said bath. With an iron content of under 20 wt.% relative to the total weight of metals which are capable of being electro-deposited in said galvanizing bath, the amount of iron in the Zn-Fe alloy layer does not fall within the above-mentioned range in the present invention. With an iron content of over 90 wt.%, on the other hand, the amount of iron is said Zn-Fe alloy layer exceeds the abovementioned range in the present invention. In the both cases, the effect of improving post-painting corrosion resistance of the electro-galvanized steel sheet is not observed.

In the present invention, the pH value of the electro-galvanizing bath should be up to 1.5. With a pH value of over 1.5, there occur irregularities in the chemical composition of the galvanized layer on the surface of the steel sheet, thus preventing an electro-galvanized layer of a uniform composition from being obtained and impairing the appearance of the electro-galvanized steel sheet. Furthermore, the amount of iron in the electro-galvanized layer, i.e., in the Zn-Fe alloy layer tends to easily vary, thus preventing not only a stable product from being obtained, but also the Zn-Fe alloy layer from containing iron in a percentage within the abovementioned range. According to our investigation, the occurrence of irregularities on the surface of the galvanized layer is attributable to the presence in mixture of iron-rich phases and zinc-rich phases in said galvanized layer.

The amount of the electro-galvanized layer formed on the surface of the steel sheet should be within the range of from 1 to 50 g/m$^2$ per side. With an amount of the electro-galvanized layer of under 1 g/m$^2$ per side, the thickness of said galvanized layer is not sufficient to give the effect of improving post-painting corrosion resistance. On the other hand, with an amount of the electro-galvanized layer of over 50 g/m$^2$ per side, while there is available the effect of improving post-painting corrosion resistance, it is not economical at all to form such a thick galvanized layer of over 50 g/m$^2$ per side by electro-galvanizing, and moreover, the excessive thickness of the galvanized layer impairs formability and weldability of the steel sheet.

We found that by causing the electro-galvanized layer to contain iron and at least one of nickel, chromium and copper, it is possible to further improve post-painting corrosion resistance of the electro-galvanized steel sheet. The reason why post-painting corrosion resistance of the electro-galvanized steel sheet is further improved by causing the electro-galvanized layer to contain iron and at least one of nickel, chromium and copper is not as yet accurately known. However, it is considered that at least one of nickel, chromium and copper, if contained in the electro-galvanized layer, causes the corrosion potential of the electro-galvanized layer to become noble, which reduces the corrosion current density produced between the steel sheet and the electro-galvanized layer, and this produces the multiplier effect through the combination with iron effect of the galvanized layer, which simultaneously further improves post-painting corrosion resistance.

The amount of at least one of nickel, chromium and copper contained in the electro-galvanized layer, i.e., in the alloy layer chiefly comprising Zn-Fe, should be within the range of from 0.01 to 10 wt.% relative to the total weight of the electro-galvanized layer. With an amount of at least one of nickel, chromium and copper in the alloy layer chiefly comprising Zn-Fe of under 0.01 wt.% relative to the total weight of the electro-galvanized layer, the above-mentioned multiplier effect does not display its full effect. On the other hand, an amount of these constituents of over 10 wt.% relative to the total weight of the electro-galvanized layer is uneconomical in that the surplus of the above expensive constituents is produced, and moreover, the formed electro-galvanized layer blackens in color, thus leading to a poor appearance of the electro-galvanized steel sheet.

The electro-galvanizing bath used in the present invention may be based on the conventional acidic electro-galvanizing bath. More specifically, zinc sulfate ($ZnSO_4.7H_2O$) is for example employed as the main Zn source, with boric acid, sodium acetate or sodium succinate as the pH value buffer, and sodium sulfate or ammonium hydrochloride as the conductive assistant.

As for the electro-galvanizing conditions in the present invention, the conventional conditions may be used without any modification. For example, a steel sheet may be subjected to an electro-galvanizing treatment under conditions including a bath temperature of from 10° to 70° C., a current density of from 10 to 40 A/dm$^2$, and an energizing time of from 40 to 350 seconds.

Now, the process for manufacturing an electro-galvanized steel sheet excellent in paint adherence of the present invention is described in more detail with reference to the following examples.

EXAMPLE 1

An electro-galvanizing treatment was applied to the surface of a steel sheet with various galvanizing current densities and various pH values under the following conditions:

| | |
|---|---|
| (1) Chemical composition of the acidic electro-galvanizing bath employed: | |
| Zinc sulfate ($ZnSO_4 . 7H_2O$) | 100 g/l |
| Iron sulfate ($FeSO_4 . 7H_2O$) | 400 g/l |
| Sodium sulfate ($Na_2SO_4$) | 30 g/l |
| Sodium acetate ($CH_3COONa$) | 12 g/l |
| (2) Electro-galvanizing conditions: | |
| Bath temperature | 40° C. and |
| Target weight of galvanized layer | 20 g/l. |

Table 1 gives amounts of iron in the electro-galvanized layer formed on the surface of said steel sheet as a result. All the values of the amount of iron in Table 1 represent weights per side.

TABLE 1

| pH value | Amount of iron in electro-galvanized layer (wt. %) | | | |
|---|---|---|---|---|
| | Current density 10A/dm$^2$ | Current density 20A/dm$^2$ | Current density 30A/dm$^2$ | Current density 40A/dm$^2$ |
| 1 | 6.0 | 9.0 | 8.0 | 20.0 |
| 2 | 20.4* | 49.0 | 55.0 | 62.4 |
| 3 | 25.0* | 43.0 | 51.3 | 57.0 |
| 4 | 24.1* | 46.0 | 53.7 | 54.7 |

As is clear from Table 1, with a pH value of the galvanizing bath of 1, the amount of iron in the electro-galvanized layer is within the range specified in the present invention regardless of the change in the galvanizing current density of from 10 to 40 A/dm$^2$, and an electro-galvanized layer with a good appearance and without irregularities in the chemical composition of the galvanized layer was obtained in all cases. With a pH value of 2 and over, in contrast, with a galvanizing current density of 10 A/dm$^2$, the amount of iron in the electro-galvanized layer was within the range in the present invention, with however serious irregularities on the surface of the galvanized layer caused by non-uniform chemical composition thereof (indicated by * in Table 1), and as a result, the electro-galvanized steel sheet was not a product capable of serving in practical use. With a pH value of 2 and over and galvanizing current density of 20 A/dm$^2$ and over, furthermore, the amount of iron in the electro-galvanized layer exceeded the range in the present invention in all cases, with early production of red rust, and no effect was observed of improving post-painting corrosion resistance.

Then, a chemical coating film was formed by an ordinary phosphating treatment on the surface of the steel sheet applied with the electro-galvanizing treatment under the above-mentioned conditions, and then, a paint film with thickness of from 15 to 20$\mu$ was formed by the electro-depositing process on said chemical coating film. Subsequently, the resultant steel sheet was subjected to a salt spray test as specified in JIS (abbreviation of the "Japanese Industrial Standard") Z 2371 to measure the time up to the occurrence of rust. Table 2 gives the results of this measurement.

TABLE 2

| pH | Time up to occurrence of rust (hr.) | | | |
|---|---|---|---|---|
| | Current density 10A/dm$^2$ | Current density 20A/dm$^2$ | Current density 30A/dm$^2$ | Current density 40A/dm$^2$ |
| 1 | 4000 min. | 4000 min. | 4000 min. | 4000 min. |
| 2 | 1500 | 900 | 700 | 500 |
| 3 | 1500 | 900 | 700 | 500 |
| 4 | 1500 | 900 | 700 | 500 |

In Tables 2, 4 and 5, the abbreviation "min." is the abbreviation of "minimum".

As is evident from Table 2, when the electro-galvanizing treatment was applied to the steel sheet with a pH value of the galvanizing bath of 1, no rust was produced on the surface of the steel sheet even when the salt spray test was continued for more than 4,000 hours, thus demonstrating very excellent results as to post-painting corrosion resistance. With a pH value of the galvanizing bath of 2 and over, the excessive amount of iron in the electro-galvanized layer resulted in early occurrence of red rust, and blisters and white rust were initiated from zinc-rich portions, thus deteriorating post-painting corrosion resistance.

EXAMPLE 2

An electro-galvanizing treatment was applied to the surface of a steel sheet with various galvanizing current densities and various pH values under the following conditions:

| | |
|---|---|
| (1) Chemical composition of the acidic electro-galvanizing bath employed: | |
| Zinc sulfate ($ZnSO_4 . 7H_2O$) | 210 g/l, |
| Iron sulfate ($FeSO_4 . 7H_2O$) | 90 g/l, |
| Sodium sulfate ($Na_2SO_4$) | 50 g/l, |
| Sodium exalate ($(CH_2COONa)_2$ | 12 g/l, |
| Citric acid ($C_6H_8O_7$) | 3 g/l; |
| (2) Electro-galvanizing conditions: | |
| Bath temperature | 50° C. |
| Target weight of galvanized layer | 30 g/m$^2$. |

Table 3 gives amounts of iron in the electro-galvanized layer formed on the surface of said steel sheet as a result. All the values of the amount of iron in Table 3 represent weights per side.

TABLE 3

| pH value | Amount of iron in electro-galvanized layer (wt. %) | | | |
|---|---|---|---|---|
| | Current density 10A/dm$^2$ | Current density 20A/dm$^2$ | Current density 30A/dm$^2$ | Current density 40A/dm$^2$ |
| 1.3 | 5.1 | 8.0 | 8.2 | 10.4 |
| 2.5 | 5.0* | 23.0* | 44.0 | 42.0 |
| 3.5 | 6.7* | 20.0* | 39.0 | 45.0 |
| 4.0 | 7.0* | 21.0* | 38.0 | 44.0 |

As is clear from Table 3, with a pH value of the galvanizing bath of 1.3, the amount of iron in the electro-galvanized layer is within the range specified in the present invention regardless of the change in the galvanizing current density of from 10 to 40 A/dm$^2$, and a uniform electro-galvanized layer with a good appearance and without irregularities in the chemical composition of the galvanized layer was obtained in all cases. With a pH value of 2.5 and over, in contrast, with a galvanizing current density of 10 A/dm$^2$ and 20 A/dm$^2$, the amount of iron in the electro-galvanized layer was within the range in the present invention, with however serious irregularities on the surface of the galvanized layer caused by non-uniform chemical composition thereof (indicated by * in Table 3), and as a result, the electro-galvanized steel sheet was not a product capable of serving in practical use. With a pH value of 2.5 and over, and a galvanizing current density of 30 A/dm$^2$ and over, furthermore, the amount of iron in the electro-galvanized layer exceeded the range in the present invention in all cases, with early production of red rust, and no effect was observed of improving post-painting corrosion resistance.

Then, a chemical coating film was formed by an ordinary phosphating treatment on the surface of the steel sheet applied with the electro-galvanizing treatment under the above-mentioned conditions, and then, a paint film with a thickness of from 15 to 20μ was formed by the electro-depositing process on said chemical coating film. Subsequently, the resultant steel sheet was subjected to a salt spray test as specified in JIS Z 2371 to measure the time up to the occurrence of rust. Table 4 gives the results of this measurement.

TABLE 4

| pH value | Time up to occurrence of rust (hr.) Current density 10A/dm² | Current density 20A/dm² | Current density 30A/dm² | Current density 40A/dm² |
|---|---|---|---|---|
| 1.3 | 4000 min. | 4000 min. | 4000 min. | 4000 min. |
| 2.5 | 1500 | 1500 | 1500 | 900 |
| 3.5 | 1500 | 1500 | 2000 | 900 |
| 4.0 | 1500 | 1500 | 2000 | 900 |

As is evident from Table 4, in the case where the electro-galvanizing treatment was applied to the steel sheet with a pH value of the galvanizing bath of 1.3, no rust was produced on the surface of the steel sheet even when the salt spray test was continued for more than 4,000 hours, thus demonstrating very excellent results as to post-painting corrosion resistance. With a pH value of the galvanizing bath of 2.5 and over, the excessive amount of iron in the electro-galvanized layer resulted in early occurrence or red rust, and blisters and white rust were initiated from zinc-rich portions, thus deteriorating post-painting corrosion resistance.

EXAMPLE 3

Under the electro-galvanizing conditions:

Bath temperature: 50° C.

Bath pH value: 1

Target weight of deposited metals: 40 g/m²

For preparing specimens Nos. 1 to 4 of the electrogalvanized steel sheet excellent in paint adherence of the present invention (hereinafter referred to as the "specimens of the present invention") containing iron of from 5 to 35 wt.% in the electro-galvanized layer relative to the weight of said electro-galvanized layer, steel sheets were subjected to an electro-galvanizing treatment in the acidic electro-galvanizing bath containing iron of from 20 to 90 wt.% relative to the total weight of metals which are capable of being electro-deposited in the acidic electrogalvanizing bath.

And, for preparing specimens of the present invention Nos. 5 to 8 containing iron of from 5 to 35 wt.% and at least one of nickel, chromium and copper of from 0.01 to 10 wt.% in the electro-galvanized layer relative to the amount of said electro-galvanized layer, steel sheets were subjected to an electro-galvanizing treatment in the acidic electro-galvanizing bath containing iron and at least one of nickel, chromium and copper of from 20 to 90 wt.% in amount relative to the total amount of metals which are capable of being electro-deposited in the acidic electro-galvanizing bath.

The specimens of the present invention Nos. 1 to 4 have an electro-galvanized layer comprising a Zn-Fe alloy layer; No. 5 has an electro-galvanized layer comprising a Zn—Fe—Cr alloy layer; No. 6 has a Zn—Fe—Ni alloy layer; No. 7 has a Zn—Fe—Cu alloy layer; and, No. 8 has a Zn—Fe-Ni—Cr alloy layer.

For comparison purposes, the following three groups, i.e., electro-galvanized steel sheets having an electro-galvanized layer in which the amount of iron is outside the scope of the present invention; a steel sheet not subjected to an electro-galvanizing treatment; and, electro-galvanized steel sheets not containing iron in the electro-galvanized layer thereof (hereinafter referred to as the "reference specimens Nos. 1 to 8") were also prepared.

The reference specimens Nos. 1 to 4 are electrogalvanized steel sheets having an electro-galvanized layer in which the amount of iron is outside the scope of the present invention; the reference specimen No. 5 is a steel sheet not subjected to an electro-galvanizing treatment; the reference specimen No. 6 is an electro-galvanized steel sheet having an ordinary pure-zinc electro-galvanized layer; the reference specimen No. 7 is an electro-galvanized steel sheet having an electro-galvanized layer comprising a Zn—Co alloy layer; and, the reference specimen No. 8 is an electro-galvanized steel sheet having an electro-galvanized layer comprising a Zn—Co—Cr alloy layer.

Post-painting corrosion resistance was evaluated on the above-mentioned specimens of the present invention Nos. 1 to 8 and reference specimens Nos. 1 to 8. A chemical coating film was formed by an ordinary phosphating treatment on the surface of the specimen, then, a paint film having a thickness of from 15 to 20μ was formed by the electro-depositing process on said chemical coating film. Post-painting corrosion resistance was evaluated on the coated specimens thus obtained by applying a salt spray test as specified in JIS Z 2371 and by measuring the time up to the occurrence of rust on the specimens and the occurrence of blisters on the specimens after the lapse of 4,000 hours in said salt spray test. The results of these measurements are comprehensively shown in Table 5.

TABLE 5

| | | Constituents (wt. %) of electro-galvanized layer | Time up to occurence of rust (hr.) | Occurence of blisters |
|---|---|---|---|---|
| Specimen | 1 | Zn:86 Fe:14 | 4,000 min. | slight |
| of | 2 | Zn:88 Fe:12 | 4,000 min. | slight |
| the | 3 | Zn:83 Fe:17 | 4,000 min. | slight |
| present | 4 | Zn:93 Fe:7 | 4,000 min. | slight |
| invention | 5 | Zn:93 Fe:6.93 Cr:0.07 | 4,000 min. | slightest |
| | 6 | Zn:82 Fe:15 Ni:3 | 4,000 min. | slightest |
| | 7 | Zn:86 Fe:13 Cu:1 | 4,000 min. | slightest |
| | 8 | Zn:88 Fe:11.3 Ni:0.5 Cr:0.2 | 4,000 min. | slightest |
| Reference | 1 | Zn:99 Fe:1 | 2,000 | serious |
| specimen | 2 | Zn:97 Fe:3 | 2,000 | serious |
| | 3 | Zn:30 Fe:70 | 500 | serious |
| | 4 | Zn:43 Fe:57 | 500 | serious |
| | 5 | — | 500 | very serious |
| | 6 | Zn:100 | 1,500 | very serious |
| | 7 | Zn:99.8 | 2,000 | very serious |

TABLE 5-continued

| | Constituents (wt. %) of electro-galvanized layer | Time up to occurence of rust (hr.) | Occurence of blisters |
|---|---|---|---|
| 8 | Co:0.2<br>Zn:99.9<br>Co:0.08<br>Cr:0.02 | 2,000 | very serious |

As is clear from Table 5, not only the steel sheet not applied with an electro-galvanizing treatment of the reference specimen 5, but also the specimens subjected to an electro-galvanizing treatment but having an electro-galvanized layer not containing iron such as the reference specimens Nos. 6, 7 and 8 show a low corrosion resistance and very serious occurrence of blisters. When the electro-galvanized layer contains iron, of which the amount is however outside the scope of the present invention, such as in the reference specimens Nos. 1, 2 and 3, corrosion resistance is low with serious occurrence of blisters. In the specimens of the present invention Nos. 1 to 8, in contrast, no rust is produced even after the lapse of 4,000 hours of salt spray test, and after 4,000 hours of salt spray test, occurrence of blisters was confirmed to be slight or slightest. Post-painting corrosion resistance of the electro-galvanized steel sheet was excellent.

According to the process for manufacturing an electro-galvanized steel sheet excellent in paint adherence of the present invention, as described above in detail, an appropriate alloy layer excellent in postpainting corrosion resistance is formed as the electrogalvanized layer. This prevents occurrence of blisters on the interface between the electro-galvanized layer and the painting film, hence largely improves post-painting corrosion resistance, i.e., corrosion resitance of the interface between the electro-galvanized layer and the painting film, while permitting formation of a uniform galvanized layer without irregularities in the amount of deposited metals, thus allowing manufacture of an electro-galvanized steel sheet of high quality and applicable in a wide range of uses. Thus, according to the present invention, many industrially useful effects are provided.

What is claimed is:

1. In a process for manufacturing a galvanized steel sheet, which comprises electro-galvanizing a steel sheet in an acidic galvanizing bath to form a galvanized layer excellent in paint adherence on the surface of said steel sheet;

the improvement characterized by comprising:

electro-galvanizing a steel sheet in an acidic zinc sulfate and iron sulfate galvanizing bath, with a pH value adjusted up to 1.5, containing iron of from 20 to 90 wt.% relative to the total amount of metals capable of being deposited in said galvanizing bath, with an electric current having a current density of from 10 to 40 A/dm$^2$, to form on the surface of said steel sheet a galvanized zinc-iron layer, containing iron of from 5 to 35 wt.% relative to the total amount of said galvanized layer in an amount of from 1 to 50 g/m$^2$ per side of said steel sheet.

2. In a process for manufacturing a galvanized steel sheet, which comprises electro-galvanizing a steel sheet in an acidic galvanizing bath to form a galvanized layer excellent in paint adherence on the surface of said steel sheet;

the improvement characterized by comprising:

electro-galvanizing a steel sheet in an acidic zinc sulfate and iron sulfate galvanizing bath, with a pH value adjusted up to 1.5, and containing iron and at least one of nickel, chromium and copper in an amount of from 20 to 90 wt.% relative to the total amount of metals capable of being deposited in said acidic galvanizing bath, with an electric current at a current density of from 10 to 40 A/dm$^2$, to form on the surface of said steel sheet a galvanized layer containing iron of from 5 to 35 wt.% and at least one of nickel, chromium and copper of from 0.01 to 10 wt.% relative to the total amount of said galvanized layer, in an amount of from 1 to 50 g/m$^2$ per side of said steel sheet.

* * * * *